United States Patent [19]

Williams

[11] Patent Number: 4,861,028

[45] Date of Patent: Aug. 29, 1989

[54] GAME BALL

[75] Inventor: Donald E. Williams, Glendale Heights, Ill.

[73] Assignee: Wilson Sporting Goods Co., River Grove, Ill.

[21] Appl. No.: 226,236

[22] Filed: Jul. 29, 1988

[51] Int. Cl.[4] ..... A63B 39/00; A63B 37/06

[52] U.S. Cl. ..... 273/60 B; 273/DIG. 4; 273/DIG. 20

[58] Field of Search ..... 273/60 R, 60 B, 60 A, 273/58 R, 58 B, 58 BA, DIG. 4, DIG. 20, 26 R

[56] References Cited

U.S. PATENT DOCUMENTS 2,776,139 1/1957 Blamey et al. ..... 273/60 B 3,652,088 3/1972 Marsh ..... 273/DIG. 4

4,367,873 1/1983 Chang et al. ..... 273/DIG. 4

4,572,507 2/1956 Hubbert ..... 273/DIG. 22

FOREIGN PATENT DOCUMENTS 2038185 2/1987 Japan ..... 273/60 B

*Primary Examiner*—George J. Marlo

[57] ABSTRACT

A softball including a hollow spherical core and a leather cover. The core is formed from a mixture of low density polyethylene and ethylene acid copolymer in which the amounts of the low density polyethylene and the ethylene acid copolymer can be adjusted to vary the coefficient of restitution of the softball from 0.47 to 0.52 at a hardness of Shore D 43 to 51.

19 Claims, 3 Drawing Sheets

GAME BALL

BACKGROUND OF THE INVENTION

This invention relates to game balls, and, in particular, to a game ball with a molded plastic core formed from low density polyethylene and ethylene copolymer.

Historically, baseballs and softballs have been made by forming a spherical core of cork, kapok, or similar material which is bound together. A layer of windings of string or yarn is wrapped over the core and a leather cover is placed over the windings and stitched together.

In recent years, game balls, particularly softballs, have been made from molded plastic cores. For example, U.S. Pat. No. 4,149,720 describes a ball which includes a polyurethane core and a leather cover. U.S. Pat. No. 4,364,565 describes a ball which includes a spherical core made from ethylene vinyl acetate copolymer.

U.S. Pat. No. 4,610,071 describes a ball which includes a core which is molded from Nucrel (ethylene acid copolymer) and filled with polyurethane. A cover is sewn over the core.

Specifications for softballs have been issued by two governing organizations, the United States Slow-pitch Softball Association (USSSA) and the Amateur Softball Association (ASA). These specifications include the following requirements:

| COEFFICIENT OF RESTITUTION | | |
|---|---|---|
| | MAXRANGE | |
| USSSA | .52 COR MAX 100% | Low Density Polyethylene (LDPE) |
| ASA | .50 COR MAX 40/60% | Ethylene Acid Copolymer (NUCREL)/LDPE +/−15% NUCREL |
| | MIDRANGE | |
| USSSA | .48 COR MAX 50/50% | NUCREL/LDPE +/−15% NUCREL |
| ASA | .47 COR MAX 30/70% | NUCREL/LDPE +/−15% NUCREL |
| CIRCUMFERENCE: | | 10⅞ inches to 12⅛ inches |
| WEIGHT: | | Not less than 5⅞ oz. nor more than 7 oz |

The coefficient of restitution (COR) is extremely important because COR determines the liveliness of the ball. COR is measured by propelling a ball against a hard surface at 60 mph (88 fps) and measuring the rebound speed of the ball. COR is expressed in terms of the ratio and the rebound speed to 60 mph (88 fps).

Other qualities of softballs are important which are not included in the foregoing "official" specifications. These qualities include the sound of the ball when batted, texture of the ball, the "feel off the bat" or, the feel which the batter experiences at the moment of impact, flight consistency, and durability.

SUMMARY OF THE INVENTION

It has been found that the COR of a molded plastic ball can be varied as desired by molding a spherical core from a mixture of low density polyethylene and ethylene acid copolymer (Nucrel). The COR decreases as more Nucrel and less low density polyethylene is used. Seams in the core can be eliminated by rotationally molding the core. The sound of the ball can be kept constant regardless of the relevant amounts of low density polyethylene and Nucrel by using materials of comparable hardness. The resulting ball has excellent feel and excellent feel at impact with the bat.

DETAILED DESCRIPTION OF THE EMBODIMENT

Figure 1:
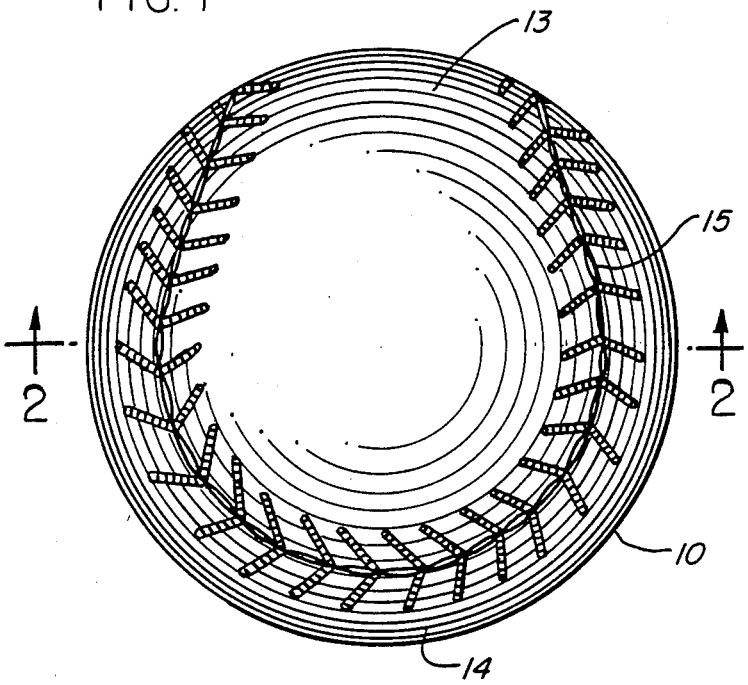
FIG. 1 illustrates a softball formed in accordance with the present invention.
Figure 2:
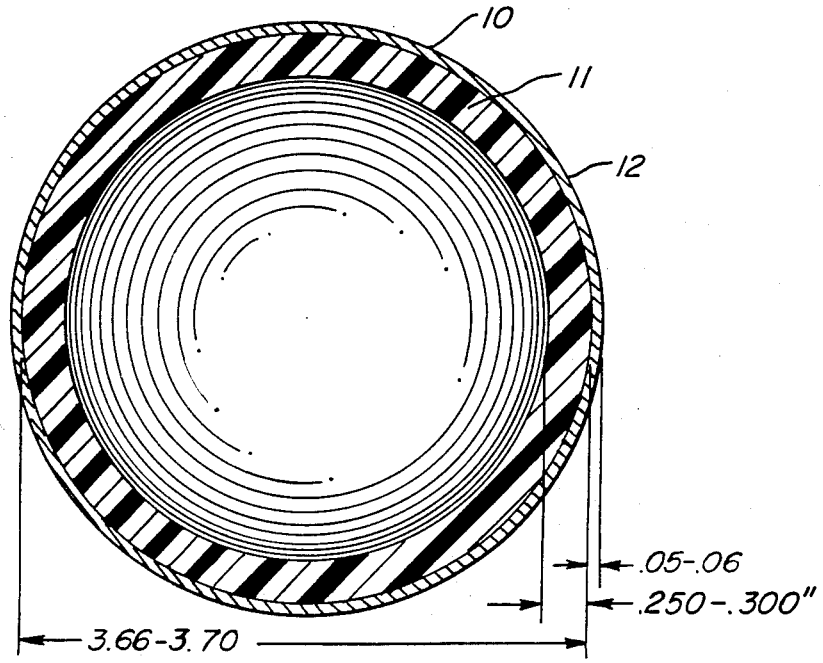
FIG. 2 is a sectional view of the softball.

The invention will be explained in conjunction with a softball 10 illustrated in the drawings, which is the preferred embodiment of the invention. However, the invention can be used to form game balls of other sizes and uses, i.e. 9 and 11 inch diameter softballs and baseballs.

The softball 10 includes a hollow spherical core 11 which forms the core of the ball and a leather cover 12 which surrounds the core. The cover is formed from two dumbbell-shaped pieces 13 and 14 which are stitched or sewn together along seams 15. As used herein the word "leather" includes natural leather as well as leather composites and other materials which are used to simulate the look and feel of leather covers.

The core 11 is molded from a mixture of low density polyethylene and ethylene acid copolymer resin which is available from E. I. Du Pont de Nemours & Co., Inc. under the name Nucrel. The low density polyethylene should typically have a density within the range of about 0.910 to about 0.925 g/cm$^3$.

In producing a ball in accordance with the present invention, it has been determined that the COR of the ball can be changed within the specification of the softball governing organizations by varying the amounts of low density polyethylene and ethylene acid copolymer. For example, the hollow spherical core of the present invention may include from about 40% to about 90% by weight low density polyethylene and from about 60% to about 10% by weight of ethylene acid copolymer to produce the desired coefficient of restitution of about 0.47 to about 0.52 for the molded plastic ball of the present invention. For the softball of the present invention to have a coefficient of restitution of about 0.50 to about 0.52, the hollow spherical core of the present invention should contain about 60% to about 90% by weight low density polyethylene and from about 40% to about 10% by weight ethylene acid copolymer. Further, to produce a softball of the present invention having a coefficient of restitution of about 0.47 to about 0.50 the hollow spherical core of the present invention should include from about 65% to about 10% by weight low density polyethylene and from about 35% to about 90% by weight ethylene acid copolymer.

In an alternate embodiment, a softball with a hollow spherical core comprising 100% by weight low density polyethylene may be produced to provide a coefficient of restitution of about 0.43 to about 0.52. Preferably, the softball of the alternative embodiment has a coefficient of restitution of about 0.52.

Figure 3:
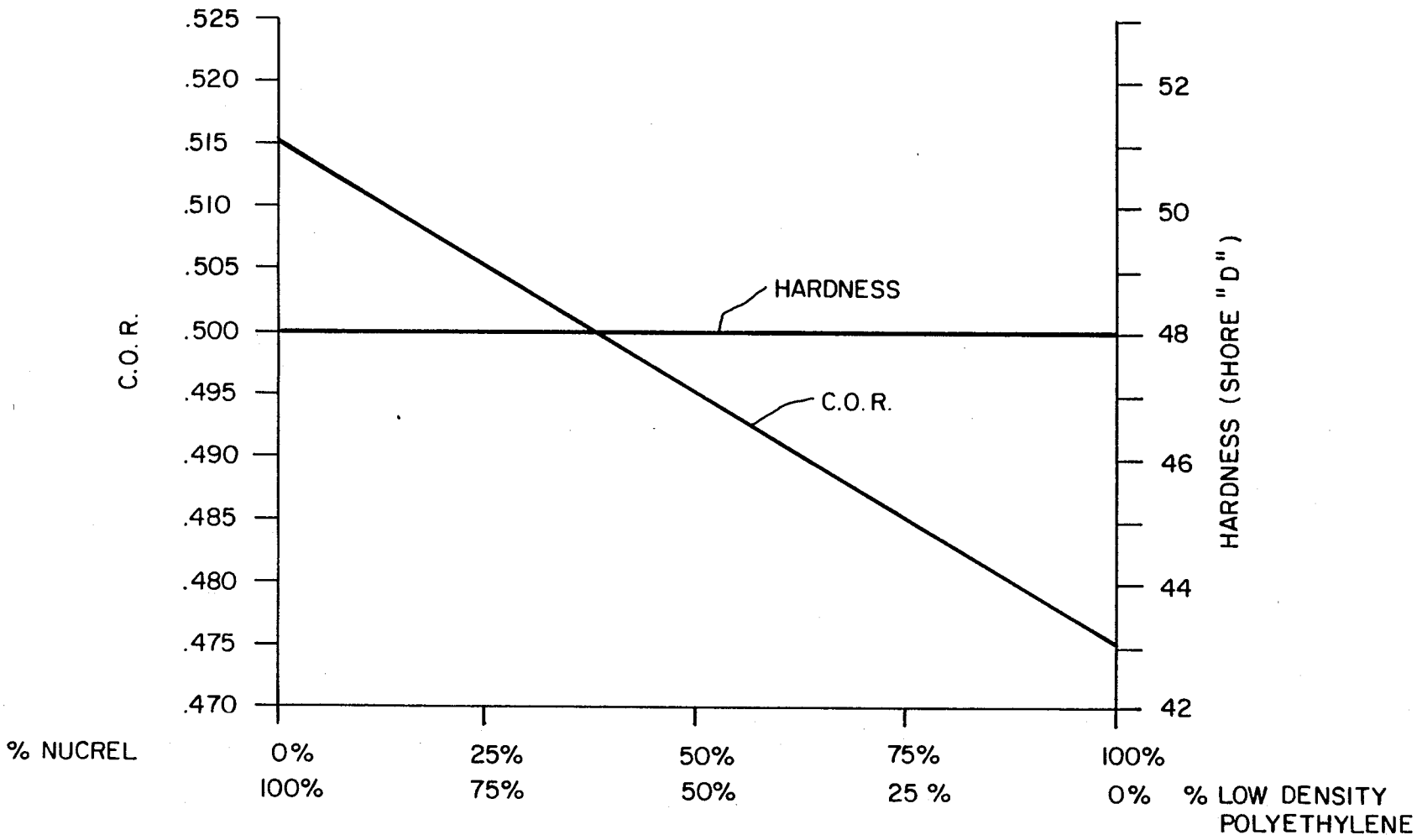
FIG. 3 illustrates the COR of softball cores of the present invention with varying amounts of low density polyethylene and ethylene acid copolymer.

In view of the above, it will be understood that a ball made in accordance with the present invention should have a hardness ranging from Shore D 43 to 51, preferably 48, to insure that the softball has the proper firmness and "sound" when it is struck by a bat. FIG. 3 shows the decrease of coefficient of restitution with increasing percentages of the ethylene acid copolymer in the formulation. Approximately, a change of minus 0.01 COR units is shown per increase of 25% by weight ethylene acid copolymer to the low density polyethylene.

Figure 4:
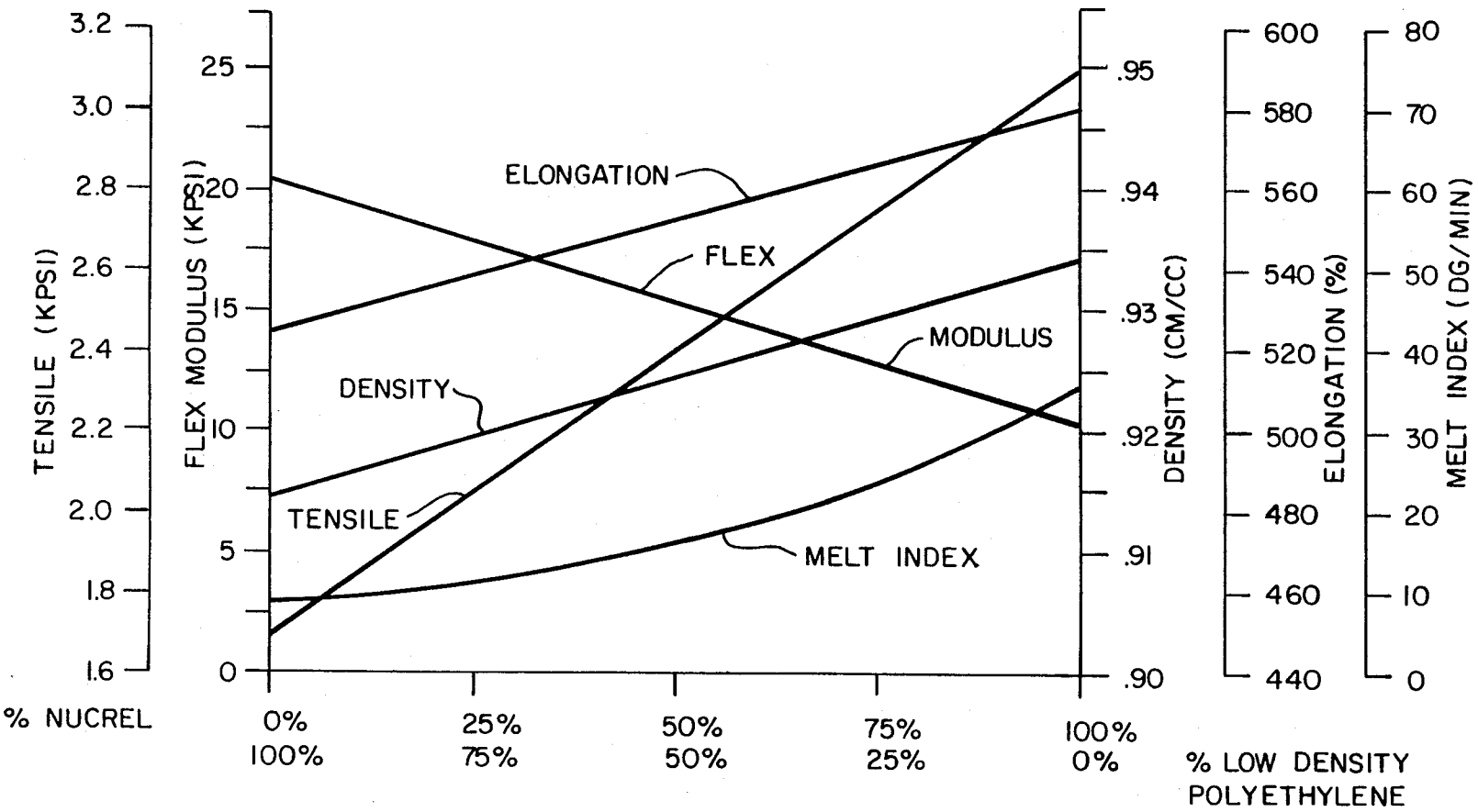
FIG. 4 illustrates various physical properties of softball cores of the present invention with varying amounts of low density polyethylene and ethylene acid copolymer.

Other parameters are shown in FIG. 4, which depicts the changes in density, strength, flexibility and polymer melt flow with increasing percentages of ethylene acid copolymer in the blend with low density polyethylene. The density relates to the final wall thickness and durability of the softball. Tensile strength relates to the durability and longevity of the product. Flexibility or flex modulus relates to the liveliness and feel of the ball off the bat. The melt flow index relates to the preferred method of manufacture, rotational molding, and the ability of the ingredients to function in that process. Parameters measured in FIG. 4 were generated from tests conventionally known to workers in the art.

The physical dimensions of the ball of the present invention should be within the specification of the governing organizations of the sport. The hollow ball may include the core thickness of about 0.250 to about 0.300 inches, a cover thickness of about 0.05 to about 0.06 inches and an outside diameter of core being about 3.66 to about 3.70 inches.

In accordance with the present invention, any conventional manufacturing techniques may be utilized to produce the hollow spherical core used in the present invention, e.g. injection molding, etc. No descriptions of these procedures should be necessary to those skilled in the art. Preferably, however, conventional rotational molding is utilized to produce the spherical core. In rotational molding, a product is formed inside a closed mold or cavity while the mold is rotating biaxially in a heated chamber. To obtain this mold rotation in two planes perpendicular to each other, the spindle is turned on a primary axis, while the molds are rotated on a secondary axis. In rotational molding, there are essentially four basic steps: loading, molding or curing, cooling and unloading.

In the loading step, either liquid or powdered polymer material is charged into a hollow mold. The mold halves are then closed and moved into an oven where the loaded mold spins biaxially. Rotation speeds should be variable at the heating station.

In the oven, the heat penetrates the mold, causing the polymer material, if it is in powder form, to melt and conform to the mold surface, or if it is in liquid form, to start to gel. The heating is usually accomplished by air or by a liquid of a high specific heat, such as molten salt or where jacketed molds are used, by a liquid medium such as oil.

As the molds are heated in the oven, they continue to rotate so that the polymer material will gradually become distributed evenly on the molded cavity through gravitational force. As the heating continues, the polymer material melts completely forming a homogeneous layer of molten plastic.

When the parts have been formed, the molds are transferred to a cooling chamber where cooling is accomplished by any means, preferably cold water spray or forced cold air. During cooling, the mold continues to rotate so that there are no distortions formed in the surface of the molded product. Lastly, the molds are opened and the parts removed either by manual or mechanical means.

For purposes of illustration, the following operational example is provided and it is not intended to be limitative of the invention.

Example 1

Appropriate concentrations of each polymer are blended according to the final COR of the ball. For example, 65% by weight low density polyethylene may be blended with 35% ethylene acid copolymer to produce a 0.50 COR game ball. The mixture is ground into a powder having the appropriate particle size. The powder is then introduced into the bottom mold half and the upper mold half is clamped in place.

The rotation process commences biaxially as the mold is placed into the oven. The temperature of the oven is set to be approximately 450° F. to about 600° F. The molds remain in the oven at the required temperature until the material cures which usually occurs in about 12–15 minutes. While the molds are still rotating, they are moved to a cooling chamber so the material solidifies and cools into the ball shape. Air or a combination of air and water are preferably used to cool the game balls. Once the game ball is solidified and cooled, the upper half of the mold is removed so that hollow spherical core may be removed from the lower half of the mold. The hollow spherical core has no seams present to insure a smooth surface for the cover of the ball made from conventional materials such as leather or synthetic material, which is then stitched onto the hollow spherical core. A hollow spherical core produced by this process in accordance with the physical dimensions described herein, when fitted with a conventional covering, should have specifications that meet the requirements of the governing softball organizations.

It will therefore be understood by those skilled in the art that the present invention provides a softball having the desired COR that can be varied in accordance with the blend of low density polyethylene and ethylene acid copolymer. The variance of the COR ma be within the standards set in the game so that the ball can be used for official play.

The ball of the present invention comprising a hollow core made from a blend of low density polyethylene and ethylene acid copolymer provides the strength, sound, hardness, the COR and feel or springiness off the bat of conventional balls.

It will be understood by those skilled in the art that the particular embodiment of the invention here presented is by way of illustration only and is meant to be in no way restrictive. Therefore, changes and modifications may be made as well as equivalents used, without departing from the spirit or scope of the invention as defined in the depending claims.

I claim:

1. A molded plastic game ball comprising a hollow spherical core of a mixture of a low density polyethylene and an ethylene acid copolymer.

2. The ball of claim 1 including a leather cover on the outside of said ball.

3. The ball of claim 1 wherein the core includes from about 40% to about 90% by weight of low density polyethylene and from about 60% to about 10% by weight of ethylene acid copolymer.

4. The ball of claim 1 wherein the core is rotationally molded.

5. The ball of claim 1 wherein the hardness ranges from about Shore D 43 to about Shore D 51.

6. The ball of claim 1 wherein the hardness is Shore D 48.

7. A softball comprising a molded hollow spherical core and a leather cover on the outside of the core, the softball having a coefficient of restitution within the range of 0.47 to 0.52, the core consisting essentially of a mixture of low density polyethylene and ethylene acid copolymer.

8. The ball of claim 7 wherein the core includes from about 40% to about 90% by weight of low density polyethylene and from about 60% to about 10% by weight of ethylene acid copolymer.

9. The ball of claim 7 wherein the softball has a coefficient of restitution of about 0.50 to about 0.52 and the core includes from about 60% to about 90% by weight of low density polyethylene and from about 40% to about 10% by weight of ethylene acid copolymer.

10. The ball of claim 7 wherein the softball has a coefficient of restitution of about 0.47 to about 0.50 and the core includes from about 60% to about 90% by weight of low density polyethylene and from about 60% to about 10% by weight of ethylene acid copolymer.

11. The ball of claim 7 wherein the thickness of the core wall is about 0.250 to about 0.300 inch.

12. The ball of claim 11 wherein the thickness of the cover is about 0.05 to about 0.06 inch.

13. The ball of claim 11 wherein the outside diameter of the core is about 3.66 to about 3.70 inches.

14. A softball comprising a molded hollow spherical core and leather cover on the outside of the core, the softball having a coefficient of restitution within the range of about 0.47 to about 0.52, the core consisting essentially of a mixture from about 40% to about 90% by weight of low density polyethylene and from about 60% to about 10% by weight ethylene acid copolymer.

15. The ball of claim 14 wherein the thickness of the core wall is about 0.250 to about 0.300 inch.

16. The ball of claim 15 wherein the thickness of the cover is about 0.05 to about 0.06 inches.

17. The ball of claim 15 wherein the outside diameter of the core is about 3.66 to about 3.70 inches.

18. The ball of claim 15 wherein the hardness ranges from about Shore D 43 to about Shore D 51.

19. The ball of claim 15 wherein the hardness is Shore D 48.

* * * * *